US012134537B2

(12) United States Patent
Nguyen

(10) Patent No.: US 12,134,537 B2
(45) Date of Patent: Nov. 5, 2024

(54) SORTER CAPABLE OF IDENTIFYING ACTUAL LOCATION OF FIRST ACTUATOR TRAVELING ALONG PLURALITY OF SHEET OUTPUT TRAYS

(71) Applicant: KYOCERA Document Solutions Inc., Osaka (JP)

(72) Inventor: Hung Manh Nguyen, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 147 days.

(21) Appl. No.: 18/117,107

(22) Filed: Mar. 3, 2023

(65) Prior Publication Data

US 2023/0286773 A1 Sep. 14, 2023

(30) Foreign Application Priority Data

Mar. 11, 2022 (JP) ..... 2022-038183

(51) Int. Cl.
*B65H 31/24* (2006.01)
*B65H 29/58* (2006.01)
(Continued)

(52) U.S. Cl.
CPC ..... *B65H 31/24* (2013.01); *B65H 29/58* (2013.01); *B65H 31/02* (2013.01); *B65H 39/11* (2013.01);
(Continued)

(58) Field of Classification Search
CPC ..... B65H 29/58; B65H 29/60; B65H 31/02; B65H 31/24; B65H 31/26; B65H 43/00;
(Continued)

(56) References Cited

U.S. PATENT DOCUMENTS 4,836,529 A * 6/1989 Kosaka ..... G03G 15/6538 271/296
5,172,908 A * 12/1992 Steinhilber ..... B07C 3/06 271/291
(Continued)

FOREIGN PATENT DOCUMENTS

JP 06179565 A * 6/1994 ..... B65H 43/06
JP 2018034939 A 3/2018

*Primary Examiner* — Prasad V Gokhale
(74) *Attorney, Agent, or Firm* — IP Business Solutions, LLC

(57) ABSTRACT

A sorter includes a plurality of sheet output trays, a first actuator, a transferring mechanism, a control device, and a plurality of tray full detection mechanisms. The first actuator travels along the plurality of sheet output trays to guide a sheet onto any one of the plurality of sheet output trays. The transferring mechanism transfers the first actuator. The control device controls an operation of the transferring mechanism. The plurality of tray full detection mechanisms are provided one for each of the plurality of sheet output trays. Each of the plurality of tray full detection mechanisms includes a second actuator and a tray full detection sensor. The control device identifies an actual location of the first actuator based on a change of a detection signal produced by a change in attitude of the second actuator due to transfer of the first actuator and output from the tray full detection sensor.

7 Claims, 22 Drawing Sheets

(51) Int. Cl.
*B65H 31/02* (2006.01)
*B65H 39/11* (2006.01)
*B65H 43/06* (2006.01)

(52) U.S. Cl.
CPC ..... *B65H 43/06* (2013.01); *B65H 2405/332* (2013.01); *B65H 2408/112* (2013.01); *B65H 2553/412* (2013.01); *B65H 2553/61* (2013.01)

(58) Field of Classification Search
CPC .. B65H 43/06; B65H 43/08; B65H 2405/332; B65H 2408/112; B65H 2553/40; B65H 2553/41; B65H 2553/412; B65H 2553/60; B65H 2553/61
See application file for complete search history.

(56) References Cited

U.S. PATENT DOCUMENTS

| | | | | |
|---|---|---|---|---|
| 6,250,631 | B1 * | 6/2001 | Hanamoto | B42C 1/125 271/298 |
| 2016/0288537 | A1 * | 10/2016 | Hirose | B65H 39/11 |
| 2018/0057296 | A1 | 3/2018 | Shirasaki | |

* cited by examiner

SORTER CAPABLE OF IDENTIFYING ACTUAL LOCATION OF FIRST ACTUATOR TRAVELING ALONG PLURALITY OF SHEET OUTPUT TRAYS

INCORPORATION BY REFERENCE

This application claims priority to Japanese Patent Application No. 2022-038183 filed on 11 Mar. 2022, the entire contents of which are incorporated by reference herein.

BACKGROUND

The present disclosure relates to a sorter that sorts sheets conveyed from an image forming apparatus.

A sorter (mailbox) is known as an optional apparatus for an image forming apparatus, such as a copier or a multifunction peripheral. The sorter includes a plurality of sheet output trays and sorts sheets conveyed from the image forming apparatus. For example, there is known a general sorter (sheet output apparatus) including a contact member that travels along a row of sheet output trays and changes the attitudes of respective associated sheet discharge guides.

SUMMARY

A technique improved over the aforementioned technique is proposed as one aspect of the present disclosure.

A sorter according to an aspect of the present disclosure includes a plurality of sheet output trays, a first actuator, a transferring mechanism, a control device, and a plurality of tray full detection mechanisms. The plurality of sheet output trays are aligned in a predetermined direction and are each capable of loading sheets thereon. The first actuator travels in the predetermined direction along the plurality of sheet output trays to guide a sheet onto any one of the plurality of sheet output trays. The transferring mechanism transfers the first actuator in the predetermined direction. The control device includes a processor and controls an operation of the transferring mechanism through the processor executing a control program. The plurality of tray full detection mechanisms are provided one for each of the plurality of sheet output trays. Each of the plurality of tray full detection mechanisms includes a second actuator and a tray full detection sensor. The second actuator is rotatable about a pivot pin in both a first rotational direction and a second rotational direction opposite to the first rotational direction. The tray full detection sensor detects a fully loaded condition of the associated sheet output tray. The second actuator includes a first portion, a second portion, and a connecting portion. The first portion is capable of abutting at a distal end thereof on an uppermost one of the sheets loaded on the associated sheet output tray. The second portion is located on a traveling path of the first actuator and disposed to fall within a predetermined detection range of the tray full detection sensor in the fully loaded condition of the associated sheet output tray. The connecting portion connects between the first portion and the second portion and biases the second portion in the second rotational direction. Each of the plurality of tray full detection mechanisms further includes a first stopper and a second stopper. The first stopper restricts rotation of the first portion in the first rotational direction. The second stopper restricts rotation of the first portion in the second rotational direction. The second actuator rotates in the first rotational direction when an amount of sheets loaded on the associated sheet output tray increases or when the second portion is pushed by the first actuator. When the second portion is pushed by the first actuator while the rotation of the first portion in the first rotational direction is stopped by the first stopper, the second portion rotates in the first rotational direction about the connecting portion. When freed from pushing of the first actuator, the second portion is restored to an original position by biasing of the connecting portion. The control device identifies an actual location of the first actuator based on a change of a detection signal produced by a change in attitude of the second actuator due to transfer of the first actuator and output from the tray full detection sensor.

DETAILED DESCRIPTION

Figure 1:
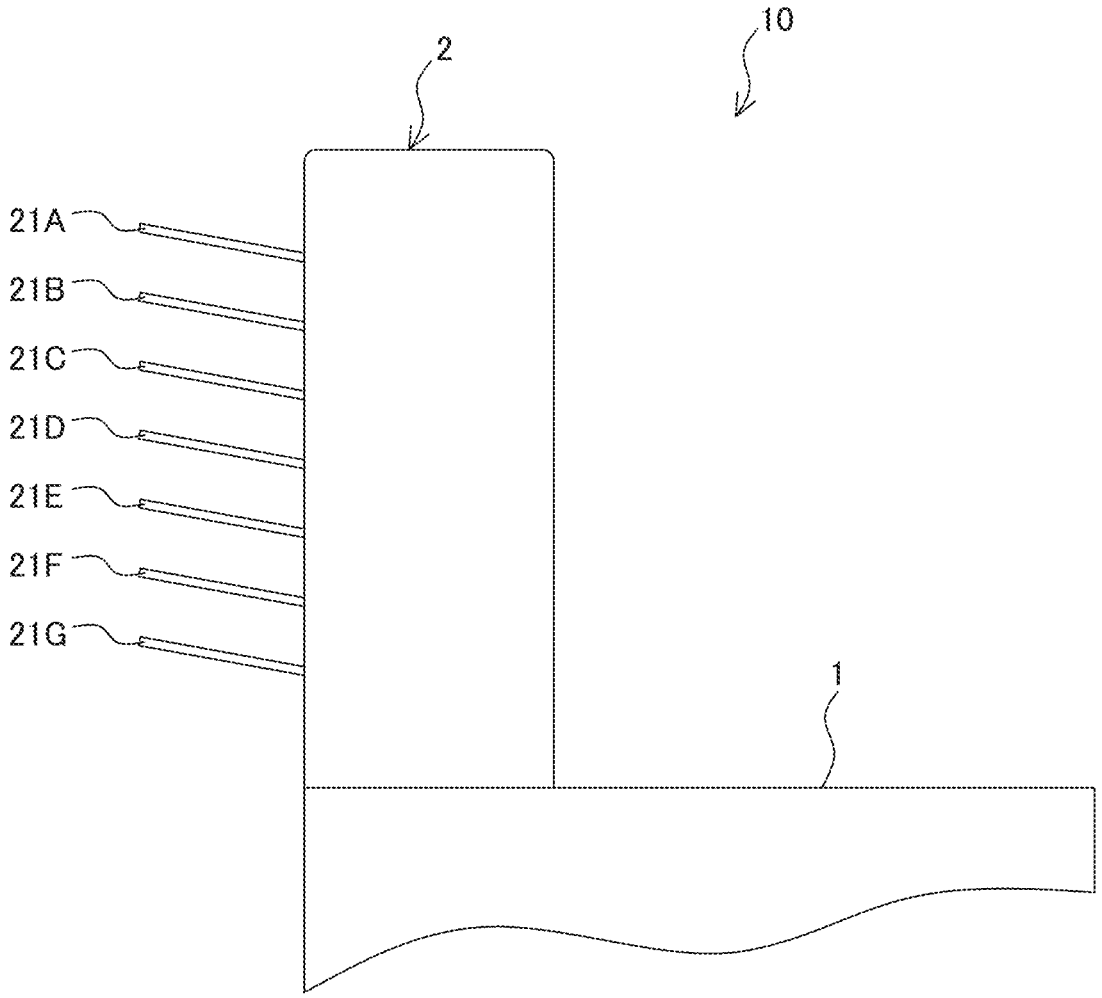
FIG. 1 is a front view showing part of an image formation system including a sorter according to an embodiment of the present disclosure.

Hereinafter, a description will be given of a sorter according to an embodiment of the present disclosure with reference to the drawings. FIG. 1 is a front view showing part of an image formation system 10 including the sorter 2 according to the embodiment of the present disclosure. The image formation system 10 includes: an image forming apparatus 1 that forms an image on a sheet; and the sorter 2 provided on top of the image forming apparatus 1.

The image forming apparatus 1 is, for example, a multi-function peripheral having multiple functions, such as a copy function, a print function, a scan function, and a facsimile function. The sorter 2 sorts a plurality of sheets conveyed from the image forming apparatus 1. The sorter 2 includes a plurality of sheet output trays 21A to 21G (hereinafter, also referred to simply as "sheet output trays 21") for use in loading sheets thereon. The plurality of sheet output trays 21A to 21G are aligned in a vertical direction which is the predetermined direction.

Figure 2:
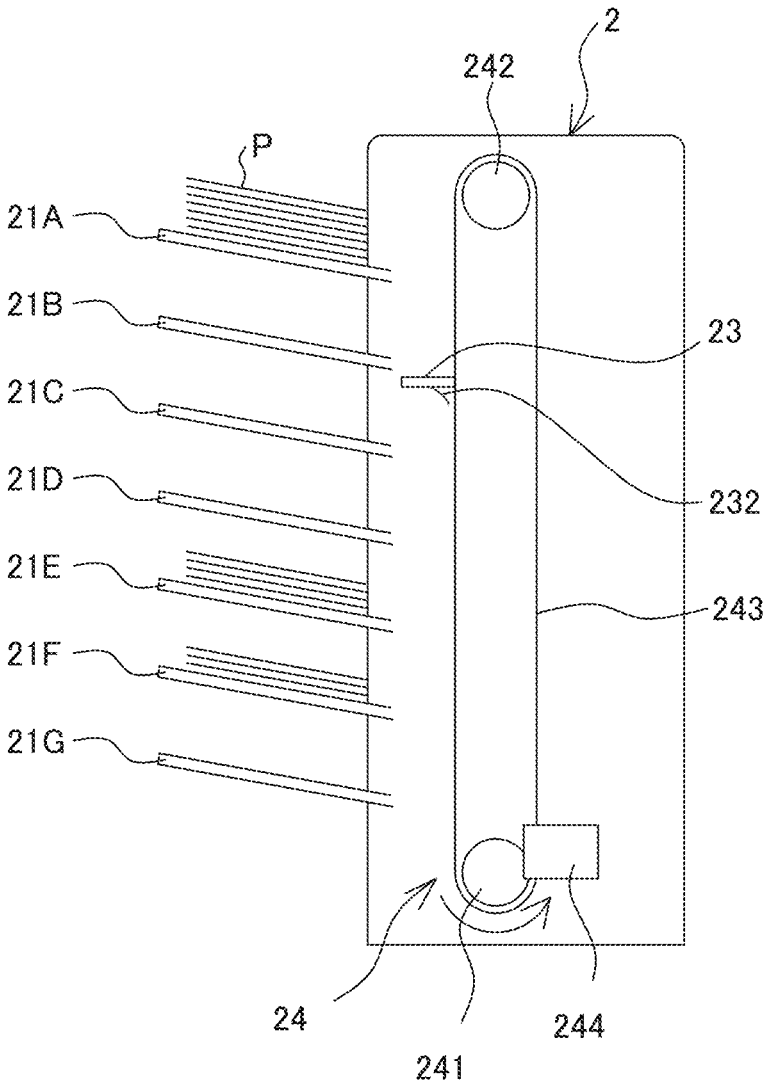
FIG. 2 is a front view showing part of the structure of the sorter.

FIG. 2 is a front view showing part of the structure of the sorter 2. The sorter 2 includes: the plurality of sheet output trays 21; a discharge and conveyance device 22 (see FIG. 11) that conveys to one of the sheet output trays 21 a sheet P coming from the image forming apparatus 1; a first actuator 23 that travels in the vertical direction along the row of the plurality of sheet output trays 21; and a transferring mechanism 24 capable of transferring the first actuator 23 in units of predetermined amounts of transfer in the vertical direction.

The discharge and conveyance device 22 includes a discharge and conveyance path, a conveyance roller, a drive motor, and so on. The discharge and conveyance path extends upward from a connecting portion thereof with the image forming apparatus 1 to an upper end of the sorter 2. The drive motor rotates the conveyance roller. The discharge and conveyance device 22 conveys upward a sheet P coming from the image forming apparatus 1 and delivers it to the location of the first actuator 23.

The first actuator 23 travels up and down along a direction of alignment of the plurality of sheet output trays 21 for the purpose of guiding the sheet P to any one of the plurality of sheet output trays 21. For example, the first actuator 23 includes a flap 232 or the like that switches between discharge rollers to be used and destinations for discharge of the sheet P. The first actuator 23 changes, by means of the flap 232, the direction of travel of the leading end of the sheet P being conveyed by the discharge and conveyance device 22 to a direction toward the sheet output tray 21 for the sheet P to be discharged, thereby directing the sheet P toward the sheet output tray 21 for the sheet P to be discharged. In this manner, the sheet P is guided onto the sheet output tray 21 located at the same height as the location where the first actuator 23 stops.

The transferring mechanism 24 includes a drive roller 241, a driven roller 242, a moving belt 243, and a drive motor 244. The moving belt 243 is mounted between the drive roller 241 and the driven roller 242. The drive motor 244 rotates the drive roller 241. The first actuator 23 is fixed to the moving belt 243. The first actuator 23 is moved down along the row of the plurality of sheet output trays 21 by counterclockwise rotation of the drive roller 241 as shown in FIG. 2. The drive motor 244 is a motor capable of positioning control (for example, a stepping motor). Therefore, the transferring mechanism 24 can transfer the first actuator 23 in units of equal amounts of transfer.

Figure 3A:
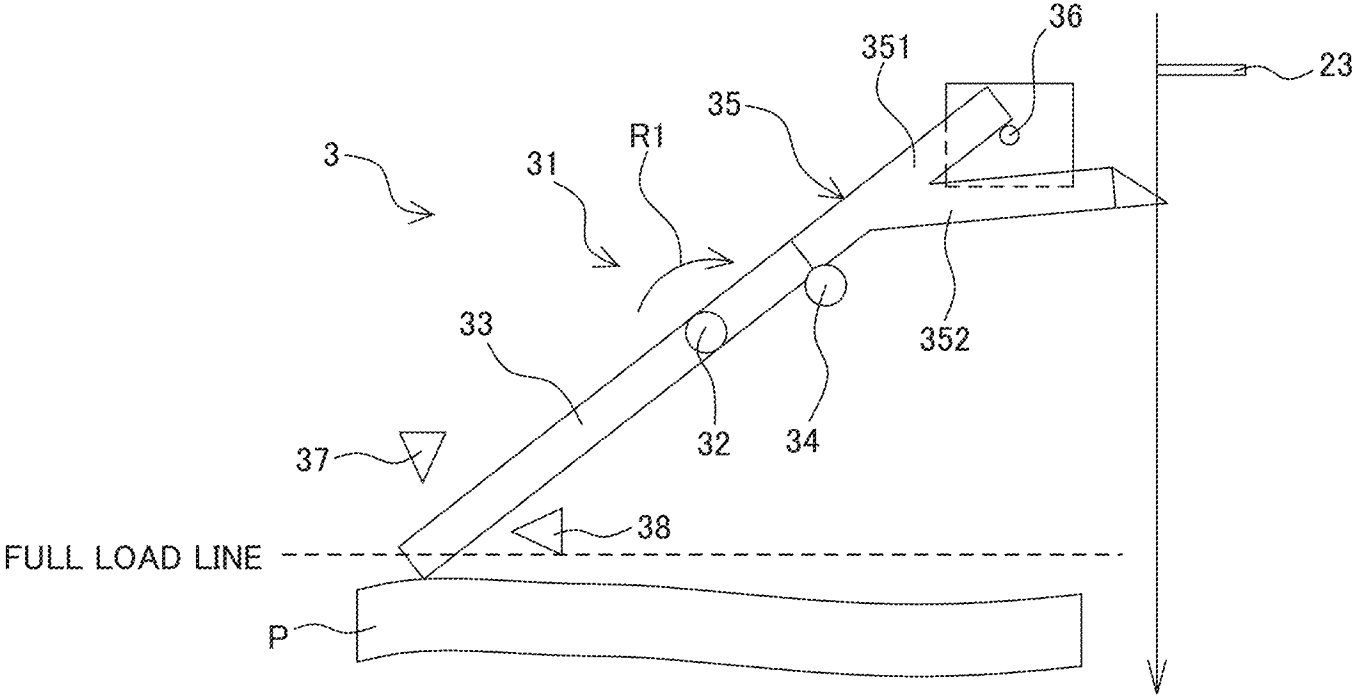
FIGS. 3A to 3C are front views showing a tray full detection mechanism.
Figure 3B:
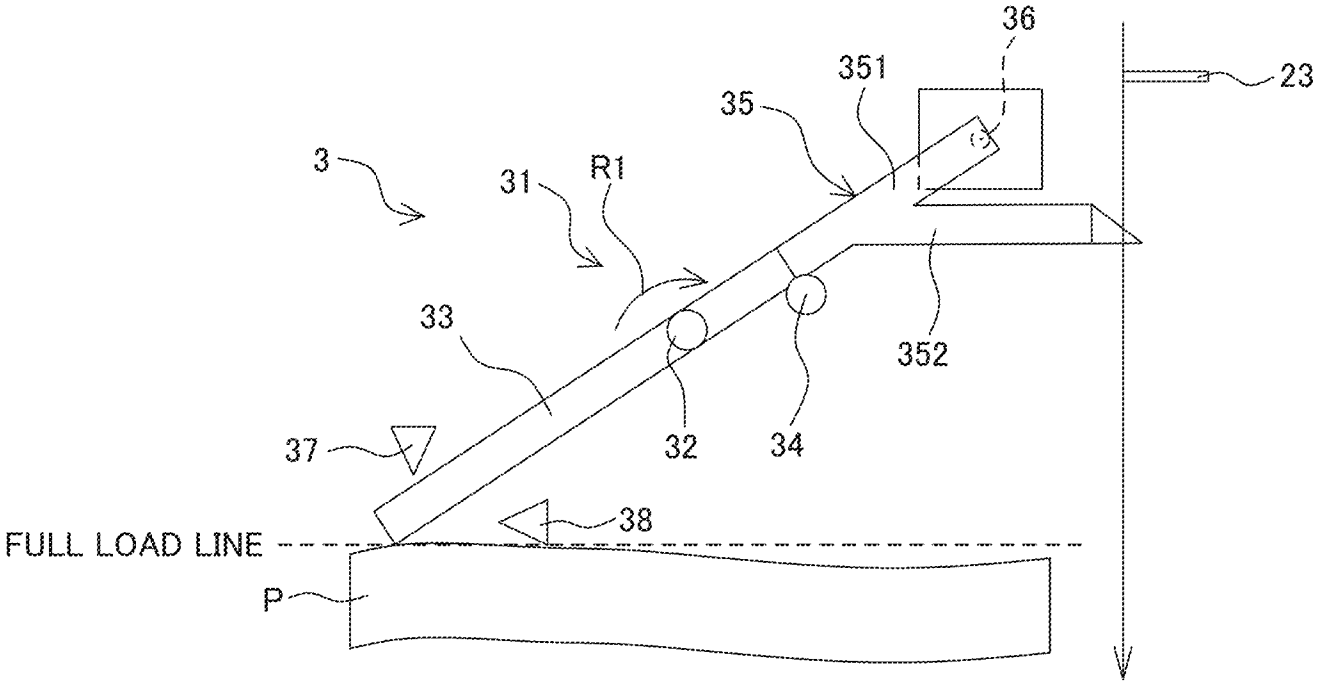
Figure 3C:
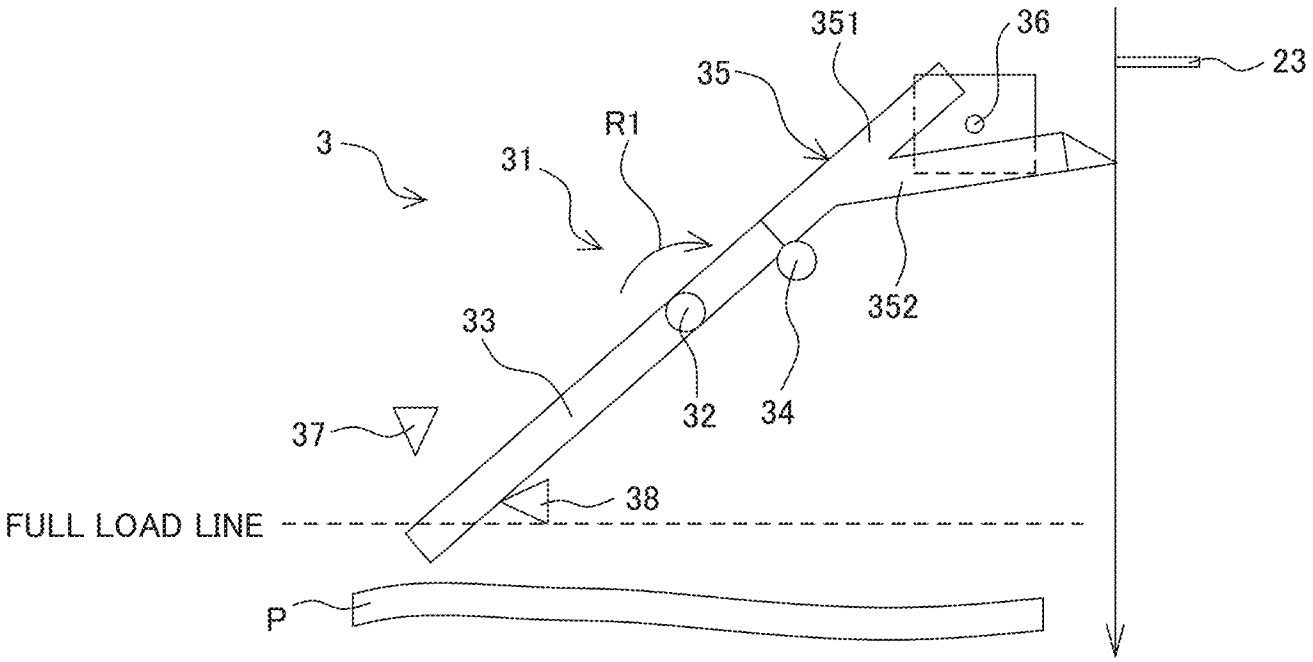
Figure 4:
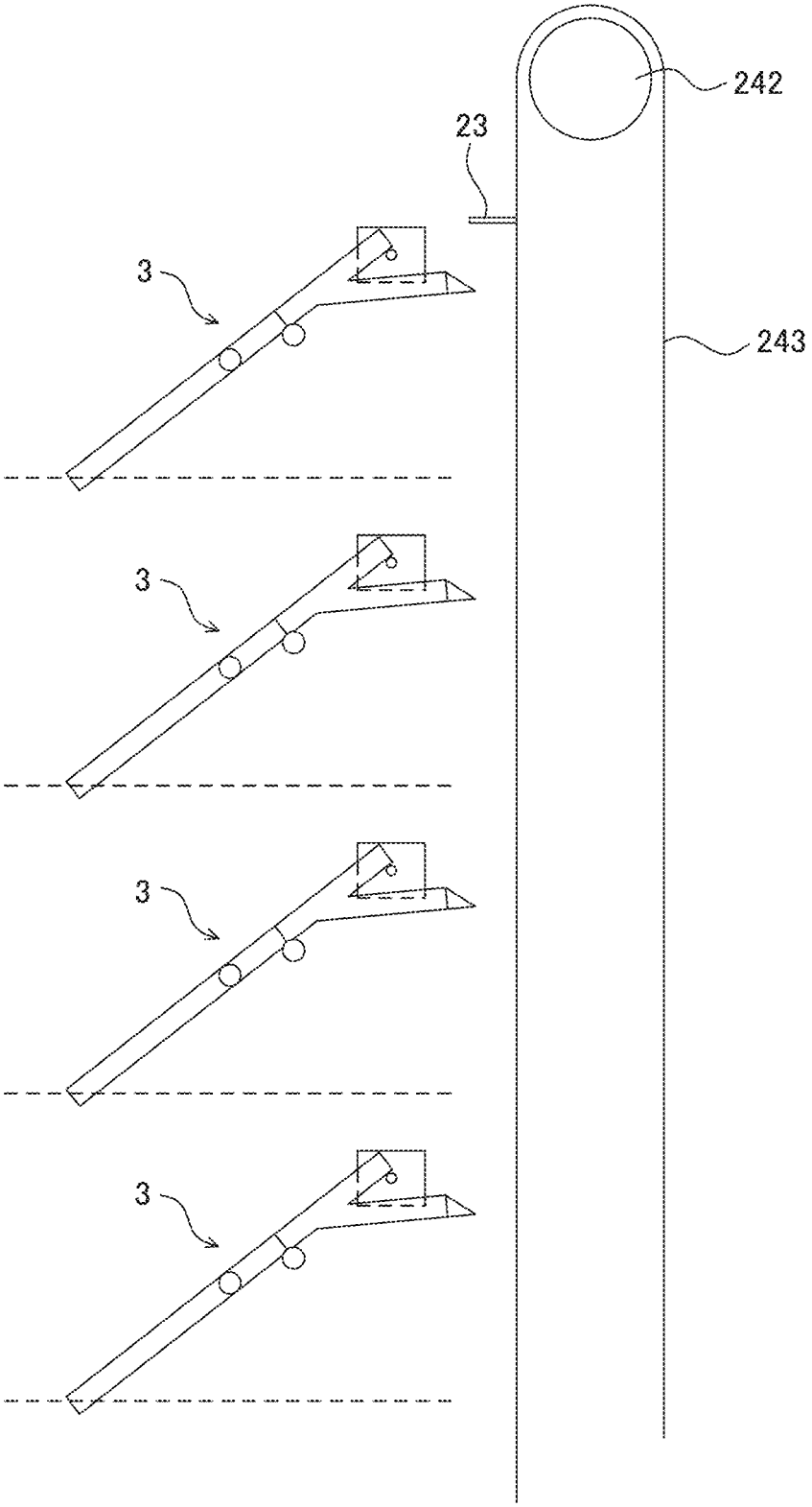
FIG. 4 is a front view showing a state where a plurality of tray full detection mechanisms are provided one for each of sheet output trays.

FIGS. 3A to 3C are front views showing a tray full detection mechanism 3. The broken line extending horizontally in FIGS. 3A to 3C represents a full load line of the sheet output tray 21 (see FIG. 2). The downward arrow in FIGS. 3A to 3C represents a traveling path of the first actuator 23. FIG. 3A shows a state where the sheet output tray 21 is in a nearly fully loaded condition. FIG. 3B shows a state where the sheet output tray 21 is in a fully loaded condition. FIG. 3C shows a state where the sheet output tray 21 is far from the fully loaded condition. FIG. 4 is a front view showing a state where a plurality of tray full detection mechanisms 3 are provided one for each of the sheet output trays 21. As shown in FIG. 4, the plurality of tray full detection mechanisms 3 are provided one for each of the plurality of sheet output trays 21A to 21G.

The tray full detection mechanism 3 detects whether or not the associated sheet output tray 21 is in a fully loaded condition. As shown in FIGS. 3A to 3C, the tray full detection mechanism 3 includes a second actuator 31, a tray full detection sensor 36, a first stopper 37, and a second stopper 38.

The second actuator 31 is rotatable about a pivot pin 32 in both a first rotational direction R1 and a second rotational direction R2 opposite to the first rotational direction R1. The second actuator 31 includes a head portion 33, a connecting portion 34, and a rear portion 35. The head portion 33 is capable of abutting at a distal end thereof on an uppermost one of sheets P loaded on the associated sheet output tray 21. The pivot pin 32 is provided on the head portion 33. The rear portion 35 is connected through the connecting portion 34 to the head portion 33. The head portion 33 corresponds to the first portion defined in CLAIMS. The rear portion 35 corresponds to the second portion defined in CLAIMS. The second actuator 31 is configured so that the moment of force of the head portion 33 relative to the pivot pin 32 is greater than that of the rear portion 35 relative to the pivot pin 32.

Figure 5A:
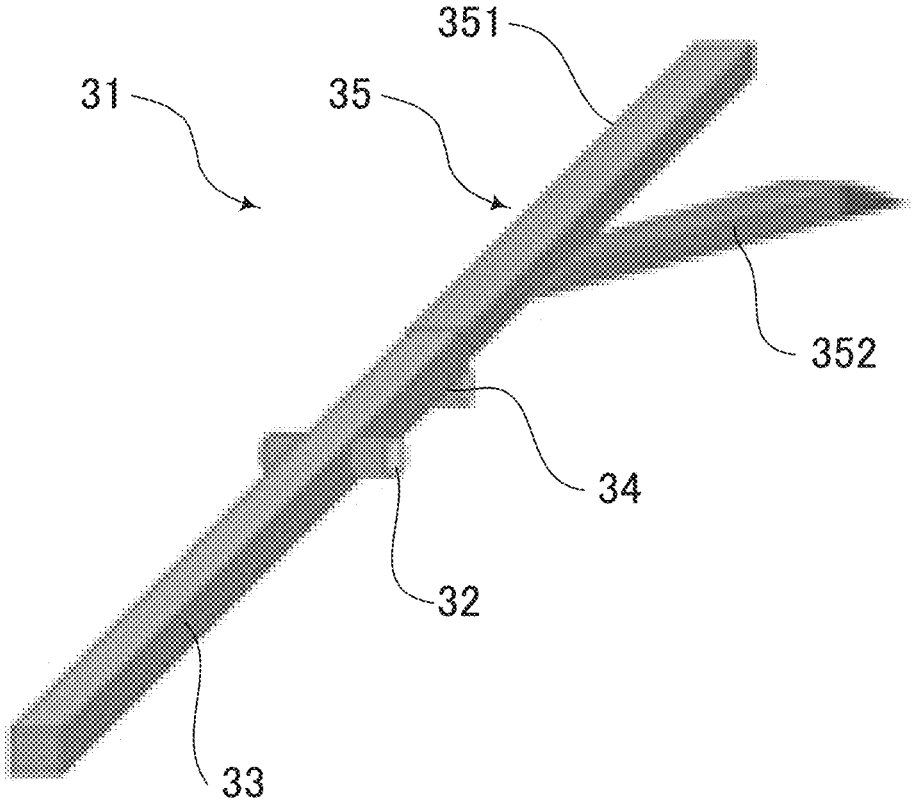
FIG. 5A is a perspective view showing a second actuator.
Figure 5B:
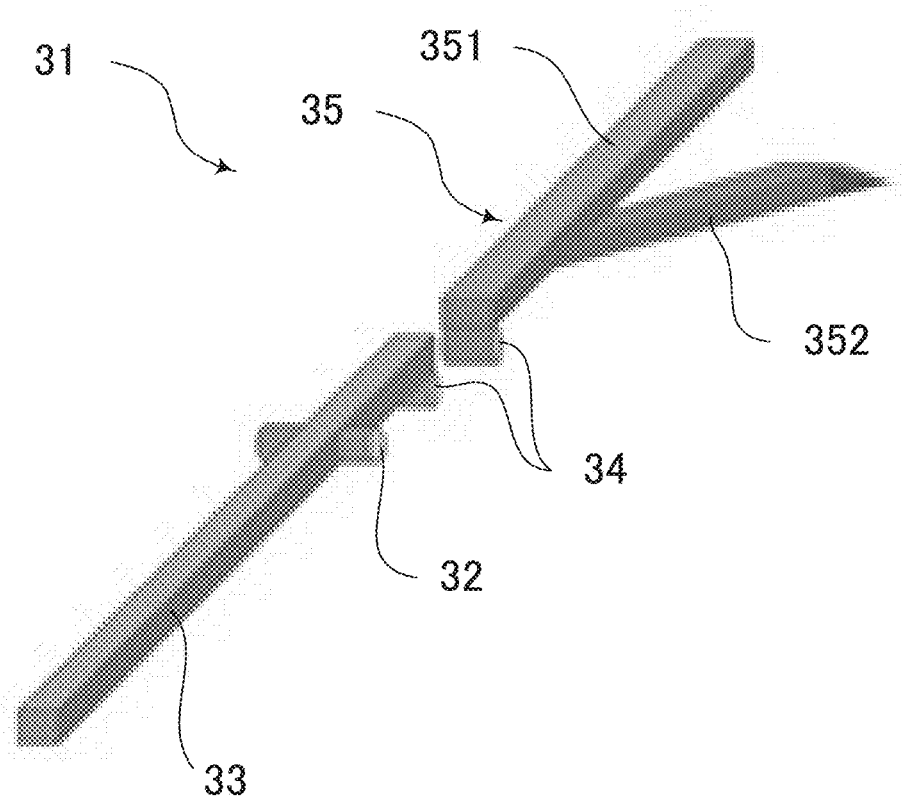
FIG. 5B is a perspective view showing a disassembled structure of the second actuator.
Figure 5C:
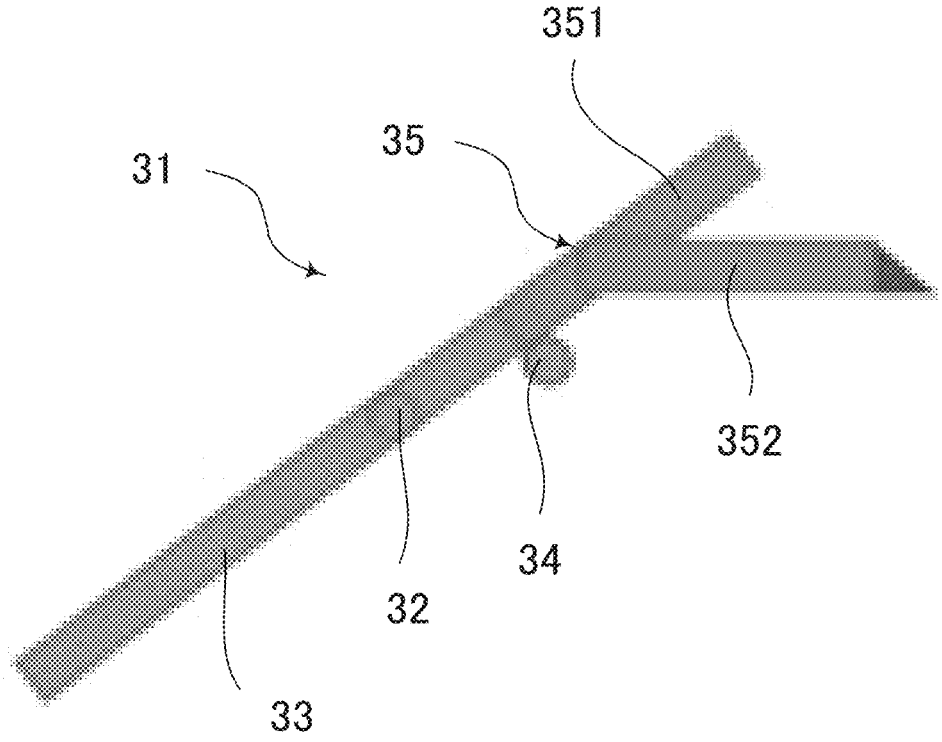
FIG. 5C is a front view showing the second actuator.
Figure 5D:
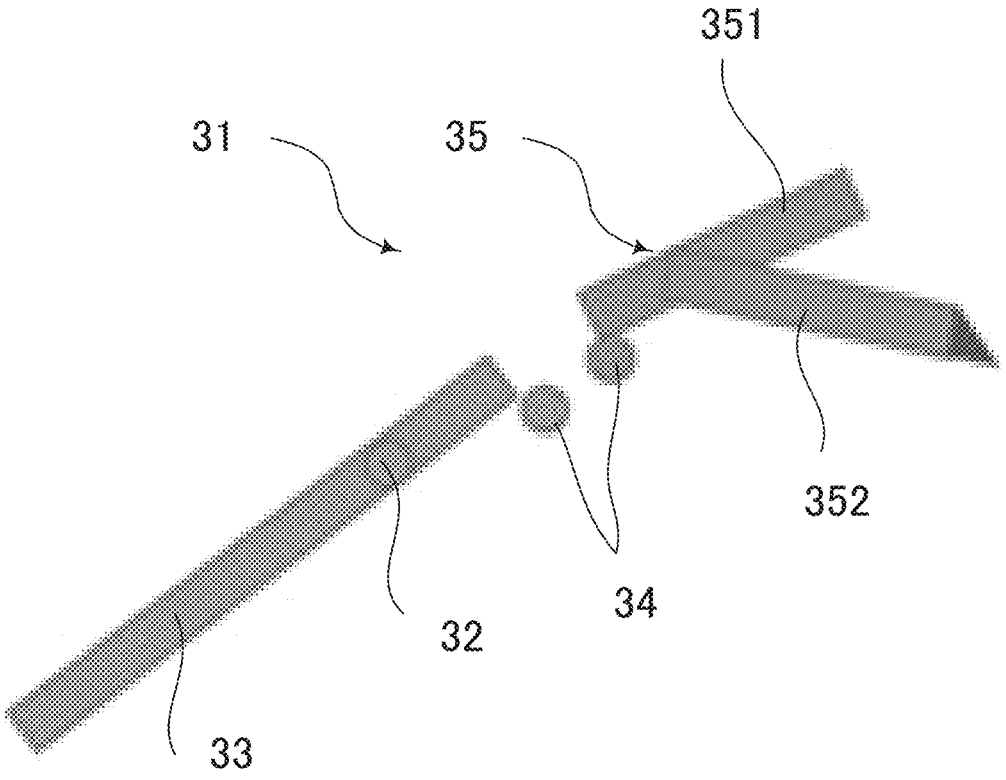
FIG. 5D is a front view showing the disassembled structure of the second actuator.

FIG. 5A is a perspective view showing the second actuator 31. FIG. 5B is a perspective view showing a disassembled structure of the second actuator 31. FIG. 5C is a front view showing the second actuator 31. FIG. 5D is a front view showing the disassembled structure of the second actuator 31.

The tray full detection sensor 36 detects a fully loaded condition of the associated sheet output tray 21. An example of the tray full detection sensor 36 is a PI sensor (photo interrupter sensor). The rear portion 35 moves in a space between a light-emitting part of the PI sensor (located in the back of the plane of the figure in FIGS. 3A to 3C) and a light-receiving part of the PI sensor (located in the front of the plane of the figure in FIGS. 3A to 3C) and, depending on the attitude of the second actuator 31, interrupts the light between the light-emitting part and the light-receiving part. When the light between the light-emitting part and the light-receiving part is interrupted, the tray full detection sensor 36 outputs an H (High) signal to a control device 26 (see FIG. 11) to be described hereinafter. Otherwise, the tray full detection sensor 36 outputs an L (Low) signal to the control device 26.

The rear portion 35 is located on the traveling path of the first actuator 23 and disposed to fall within a predetermined detection range of the tray full detection sensor 36 in the fully loaded condition of the associated sheet output tray 21. Specifically, the rear portion 35 divides into two rear branches. A first rear portion 351, which is one of the two branches, moves in a space between the light-emitting part and the light-receiving part of the tray full detection sensor 36.

The first rear portion 351 is disposed to fall within the predetermined detection range of the tray full detection sensor 36 when the associated sheet output tray 21 is in a fully loaded condition. For example, as shown in FIG. 3B, the first rear portion 35 is disposed to block the optical path of the tray full detection sensor 36 when a stack of sheets P reaches the full load line (when the sheet output tray 21 is in a fully loaded condition). Therefore, when the sheet output tray 21 is in a fully loaded condition, the tray full detection sensor 36 outputs an H signal to the control device 26.

A second rear portion 352, which is the other of the two branches, is disposed on the traveling path of the first actuator 23. Therefore, the rear portion 35 can be pushed by the first actuator 23. When the amount of sheets loaded on the associated sheet output tray 21 increases or when the rear portion 35 (specifically, the second rear portion 352) is pushed by the first actuator 23, the second actuator 31 rotates in the first rotational direction R1 (the clockwise direction in FIGS. 3A to 3C) about the pivot pin 32.

The first stopper 37 restricts the rotation of the head portion 33 in the first rotational direction R1. The second stopper 38 restricts the rotation of the head portion 33 in the second rotational direction R2 (the counterclockwise direction in FIGS. 3A to 3C). The connecting portion 34 connects between the head portion 33 and the rear portion 35 and biases the rear portion 35 in the second rotational direction R2. An example of the connecting portion 34 is a spring coupling.

When the rear portion 35 is pushed by the first actuator 23 while the rotation of the head portion 33 in the first rotational direction R1 is stopped by the first stopper 37, the rear portion 35 rotates in the first rotational direction R1 about the connecting portion 34. When freed from the pushing of the first actuator 23, the rear portion 35 is rotated in the second rotational direction R2 about the connecting portion 34 by the biasing of the connecting portion 34 and thus returns to its original position.

Figure 6A:
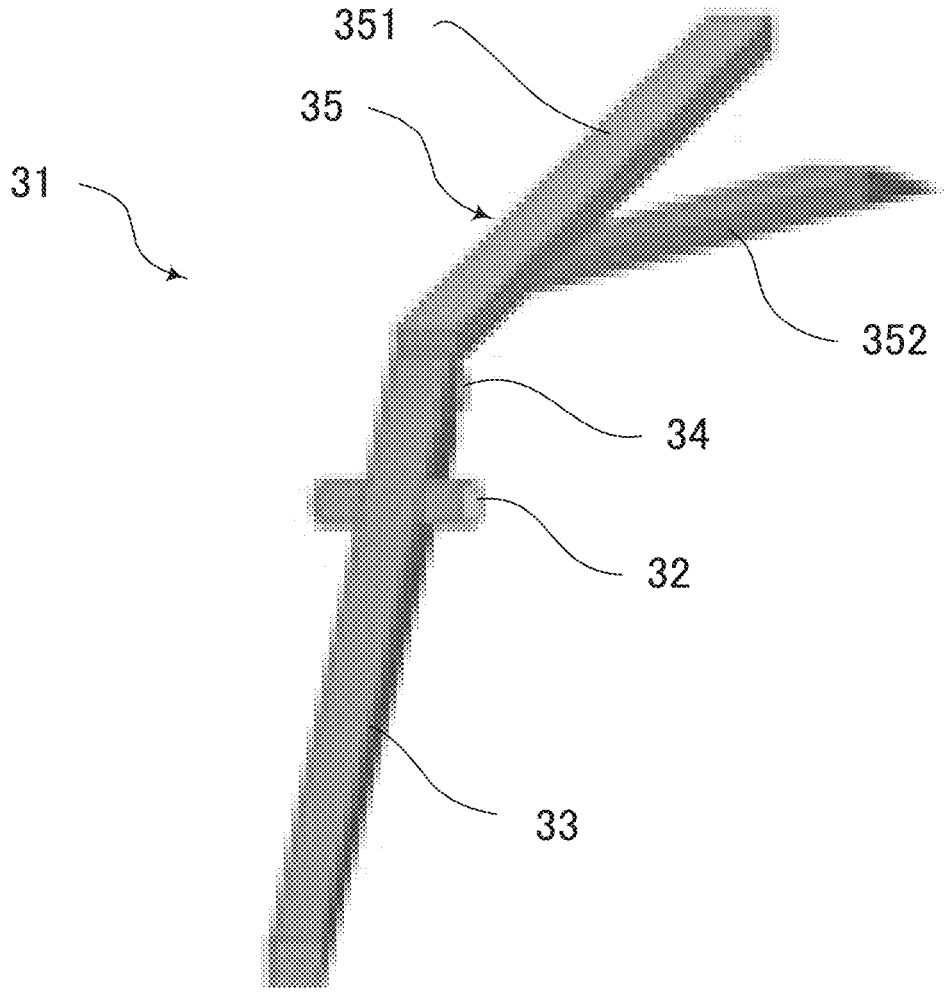
FIGS. 6A and 6B are views showing a state where a rear portion rotates in a first rotational direction about a connecting portion.
Figure 6B:
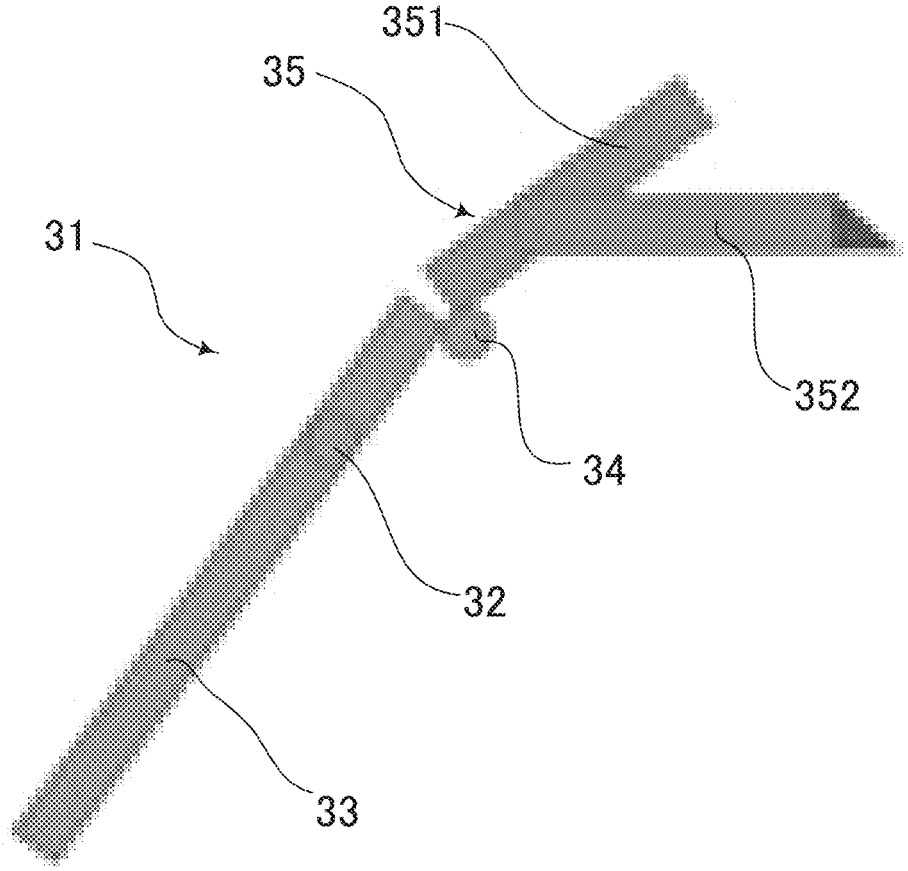
Figure 7:
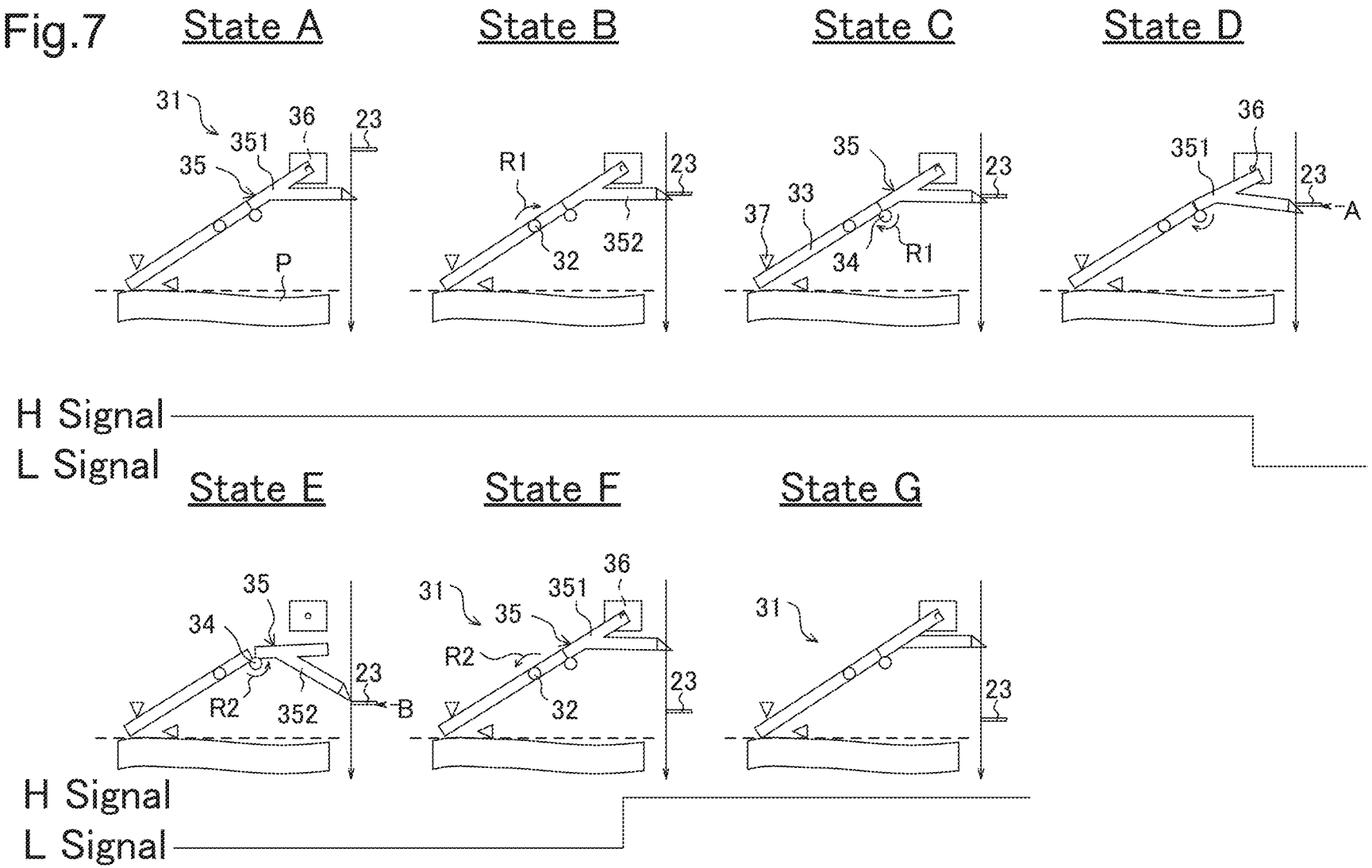
FIG. 7 shows how a detection signal output from a tray full detection sensor changes according to the change in attitude of the second actuator when the sheet output tray is in a fully loaded condition.

FIGS. 6A and 6B are views showing a state where the rear portion 35 rotates in the first rotational direction R1 about the connecting portion 34. FIG. 6A shows a perspective view. FIG. 6B shows a front view. FIG. 7 shows how a detection signal output from the tray full detection sensor 36 changes according to the change in attitude of the second actuator 31 due to the transfer of the first actuator 23 when the sheet output tray 21 is in a fully loaded condition.

Referring to FIG. 7, when the sheet output tray 21 is in a fully loaded condition as shown in State A, the first rear portion 351 blocks the optical path of the tray full detection sensor 36. In this state, the tray full detection sensor 36 outputs an H signal. When, as shown in State B, the first actuator 23 travels, makes contact with the second rear portion 352, and pushes down the second rear portion 352, the second actuator 31 rotates in the first rotational direction R1 about the pivot pin 32. When the head portion 33 reaches the first stopper 37 as shown in State C, the rear portion 35 rotates in the first rotational direction R1 about the connecting portion 34.

When the first actuator 23 reaches Position A as shown in State D, the first rear portion 351 no longer blocks the optical path of the tray full detection sensor 36 and falls out of the detection range. At this time, the output signal from the tray full detection sensor 36 falls from a high level (an H signal) to a low level (an L signal). When, as shown in State E, the first actuator 24 further travels and reaches Position B, the second rear portion 352 is freed from the pushing of the first actuator 23. The rear portion 35 is rotated in the second rotational direction R2 about the connecting portion 34 by the biasing of the connecting portion 34.

When, as shown in State F, the rear portion 35 returns to the original position, the second actuator 31 rotates in the second rotational direction R2 about the pivot pin 32. Thus, the first rear portion 351 blocks the optical path of the tray full detection sensor 36 and, as a result, the output signal from the tray full detection sensor 36 rises from a low level (an L signal) to a high level (an H signal). After State F, the second actuator 31 returns to its original attitude as shown in State G.

Figure 8:
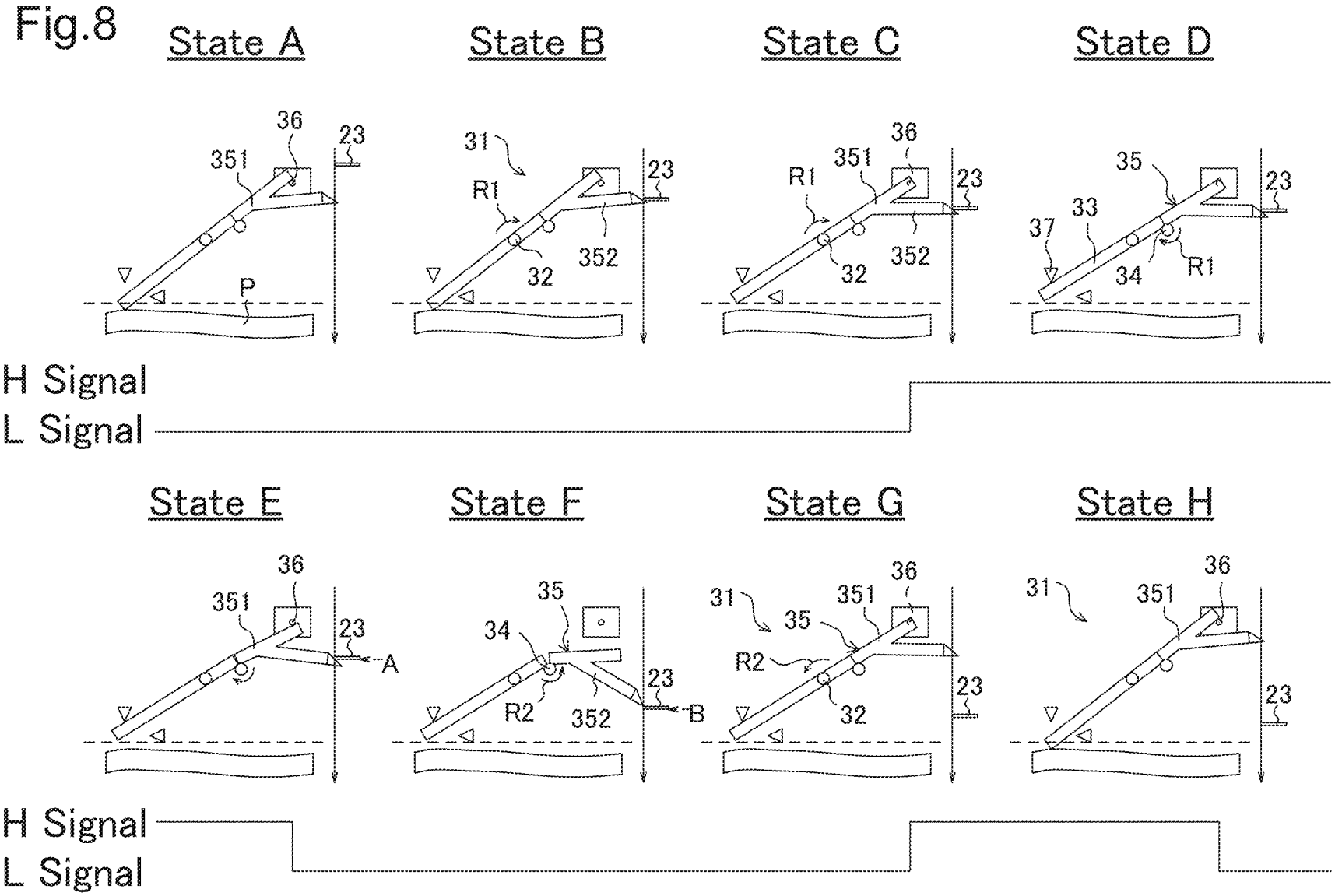
FIG. 8 shows how the detection signal output from the tray full detection sensor changes according to the change in attitude of the second actuator when the sheet output tray is in a nearly fully loaded condition.

FIG. 8 shows how a detection signal output from the tray full detection sensor 36 changes according to the change in attitude of the second actuator 31 due to the transfer of the first actuator 23 when the sheet output tray 21 is in a nearly fully loaded condition. Referring to FIG. 8, because, as shown in State A, the sheet output tray 21 is not in a fully loaded condition, the first rear portion 351 does not block the optical path of the tray full detection sensor 36. In this case, the tray full detection sensor 36 outputs an L signal.

When, as shown in State B, the first actuator 23 travels, makes contact with the second rear portion 352, and pushes down the second rear portion 352, the second actuator 31 rotates in the first rotational direction R1 about the pivot pin 32. After a while, as shown in State C, the first rear portion 351 blocks the optical path of the tray full detection sensor 36. At this time, the output signal from the tray full detection sensor 36 rises from a low level (an L signal) to a high level (an H signal).

When the head portion 33 reaches the first stopper 37 as shown in State D, the rear portion 35 rotates in the first rotational direction R1 about the connecting portion 34. When the first actuator 23 reaches Position A as shown in State E, the first rear portion 351 no longer blocks the optical path of the tray full detection sensor 36 and falls out of the detection range. At this time, the output signal from the tray full detection sensor 36 falls from a high level (an H signal) to a low level (an L signal).

When, as shown in State F, the first actuator 23 further travels and reaches Position B, the second rear portion 352 is freed from the pushing of the first actuator 23. The rear portion 35 is rotated in the second rotational direction R2 about the connecting portion 34 by the biasing of the connecting portion 34. When, as shown in State G, the rear portion returns to the original position, the second actuator 31 rotates in the second rotational direction R2 about the pivot pin 32.

As shown in State H, the second actuator 31 returns to its original attitude. At this time, the first rear portion 351 does not block the optical path of the tray full detection sensor 36 and, therefore, the tray full detection sensor 36 outputs an L signal. When, as shown in State G, the second rear portion 352 is freed from the pushing of the first actuator 23, the first rear portion 351 blocks the optical path of the tray full detection sensor 36 for a moment. As a result, the output signal from the tray full detection sensor 36 rises for a moment and then falls.

Figure 9:
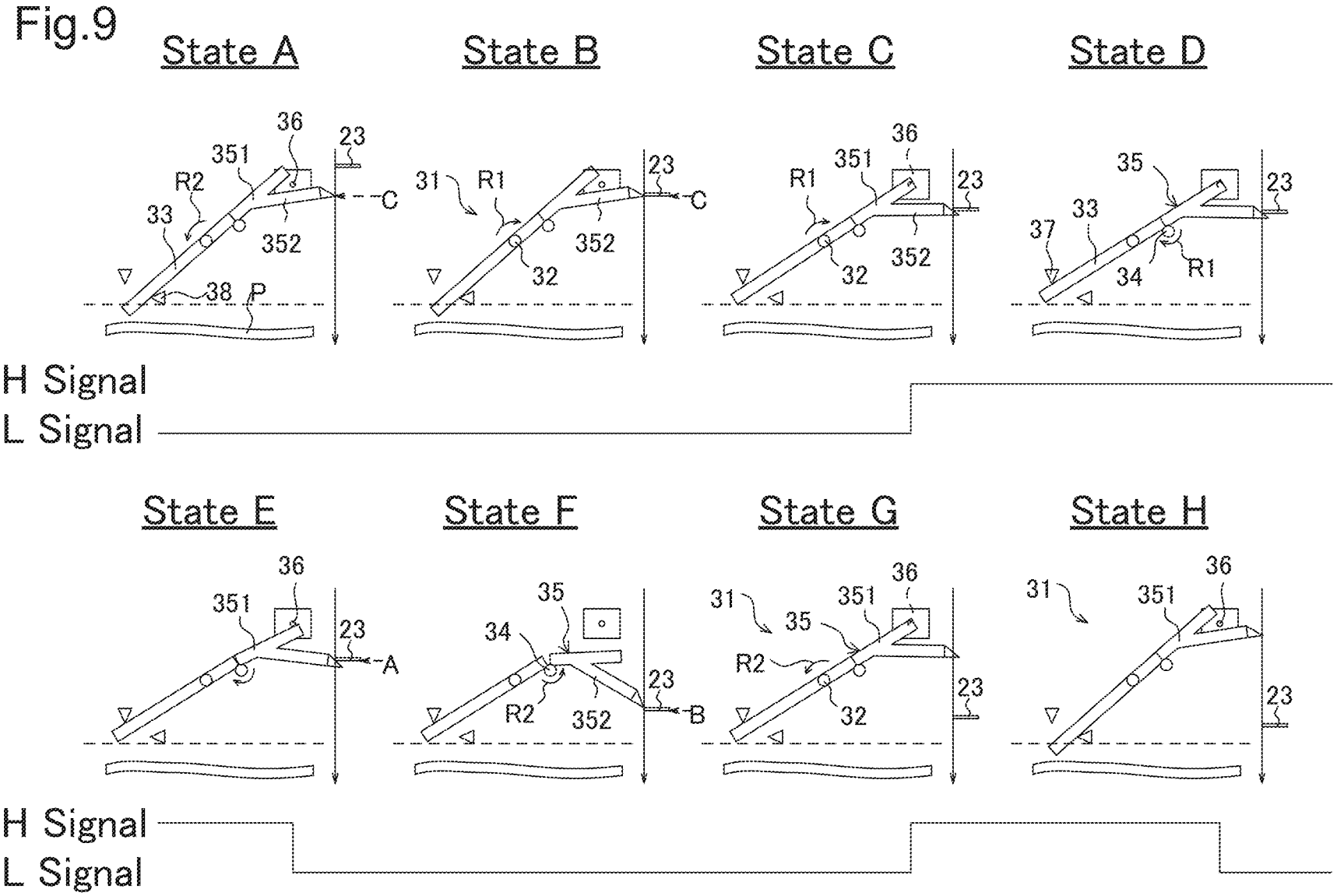
FIG. 9 shows how the detection signal output from the tray full detection sensor changes according to the change in attitude of the second actuator when the sheet output tray is far from the fully loaded condition.

FIG. 9 shows how a detection signal output from the tray full detection sensor 36 changes according to the change in attitude of the second actuator 31 due to the transfer of the first actuator 23 when the sheet output tray 21 is far from a fully loaded condition.

Referring to FIG. 9, when, as shown in State A, the sheet output tray 21 is not in a fully loaded condition, the first rear portion 351 does not block the optical path of the tray full detection sensor 36. In this state, the tray full detection sensor 36 outputs an L signal. Furthermore, when the sheet output tray 21 is far from a fully loaded condition, the distal end of the head portion 33 does not abut on an uppermost sheet P and the rotation of the head portion 33 in the second rotational direction R2 is stopped by the second stopper 38. As a result, the second rear portion 352 is located at a reachable highest point (Position C).

When, as shown in State B, the first actuator 23 reaches Position C, makes contact with the second rear portion 352, and pushes down the second rear portion 352, the second actuator 31 rotates in the first rotational direction R1 about the pivot pin 32. After a while, as shown in State C, the first rear portion 351 blocks the optical path of the tray full detection sensor 36. At this time, the output signal from the tray full detection sensor 36 rises from a low level (an L signal) to a high level (an H signal).

When the head portion 33 reaches the first stopper 37 as shown in State D, the rear portion 35 rotates in the first rotational direction R1 about the connecting portion 34. When the first actuator 23 reaches Position A as shown in State E, the first rear portion 351 no longer blocks the optical path of the tray full detection sensor 36 and falls out of the detection range. At this time, the output signal from the tray full detection sensor 36 falls from a high level (an H signal) to a low level (an L signal).

When, as shown in State F, the first actuator 23 further travels and reaches Position B, the second rear portion 352 is freed from the pushing of the first actuator 23. The rear portion 35 is rotated in the second rotational direction R2 about the connecting portion 34 by the biasing of the connecting portion 34. When, as shown in State G, the rear portion 35 returns to the original position, the second actuator 31 rotates in the second rotational direction R2 about the pivot pin 32.

As shown in State H, the second actuator 31 returns to its original attitude. At this time, the first rear portion 351 does not block the optical path of the tray full detection sensor 36 and, therefore, the tray full detection sensor 36 outputs an L signal. When, as shown in State G, the second rear portion 352 is freed from the pushing of the first actuator 23, the first rear portion 351 blocks the optical path of the tray full detection sensor 36 for a moment. As a result, the output signal from the tray full detection sensor 36 rises for a moment and then falls.

Figure 10:
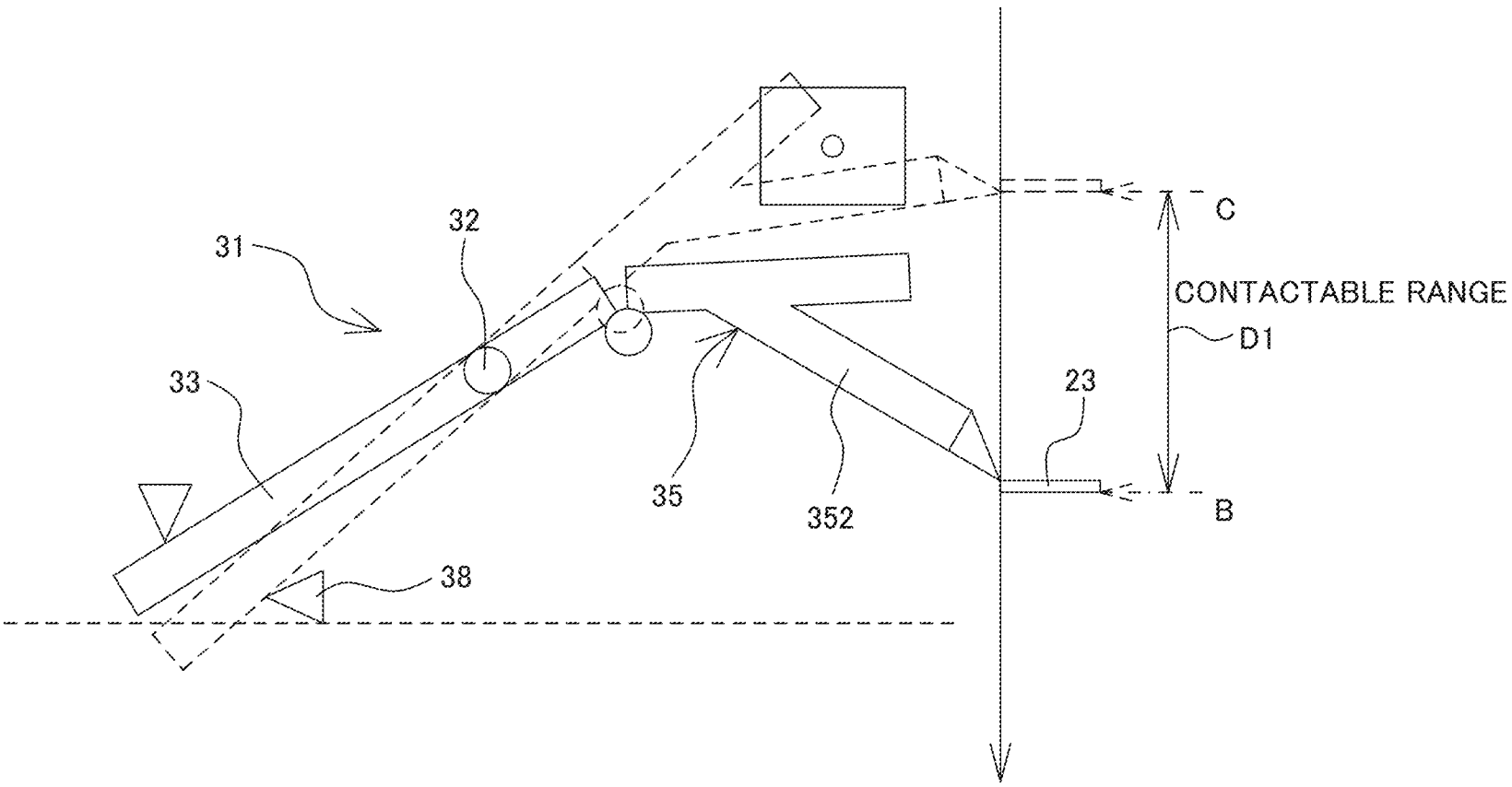
FIG. 10 is a view showing a contactable range between the first actuator and the rear portion.

FIG. 10 is a view showing a contactable range between the first actuator 23 and the rear portion 35. As shown in FIG. 10, a range from Position C shown in State B in FIG. 9 (the reachable highest point of the second rear portion 352) to Position B shown in State F in FIG. 9 is the contactable range within which the first actuator 23 and the rear portion 35 can make contact with each other. In FIG. 10, D1 represents a traveling distance of the first actuator 23 in the contactable range.

Figure 11:
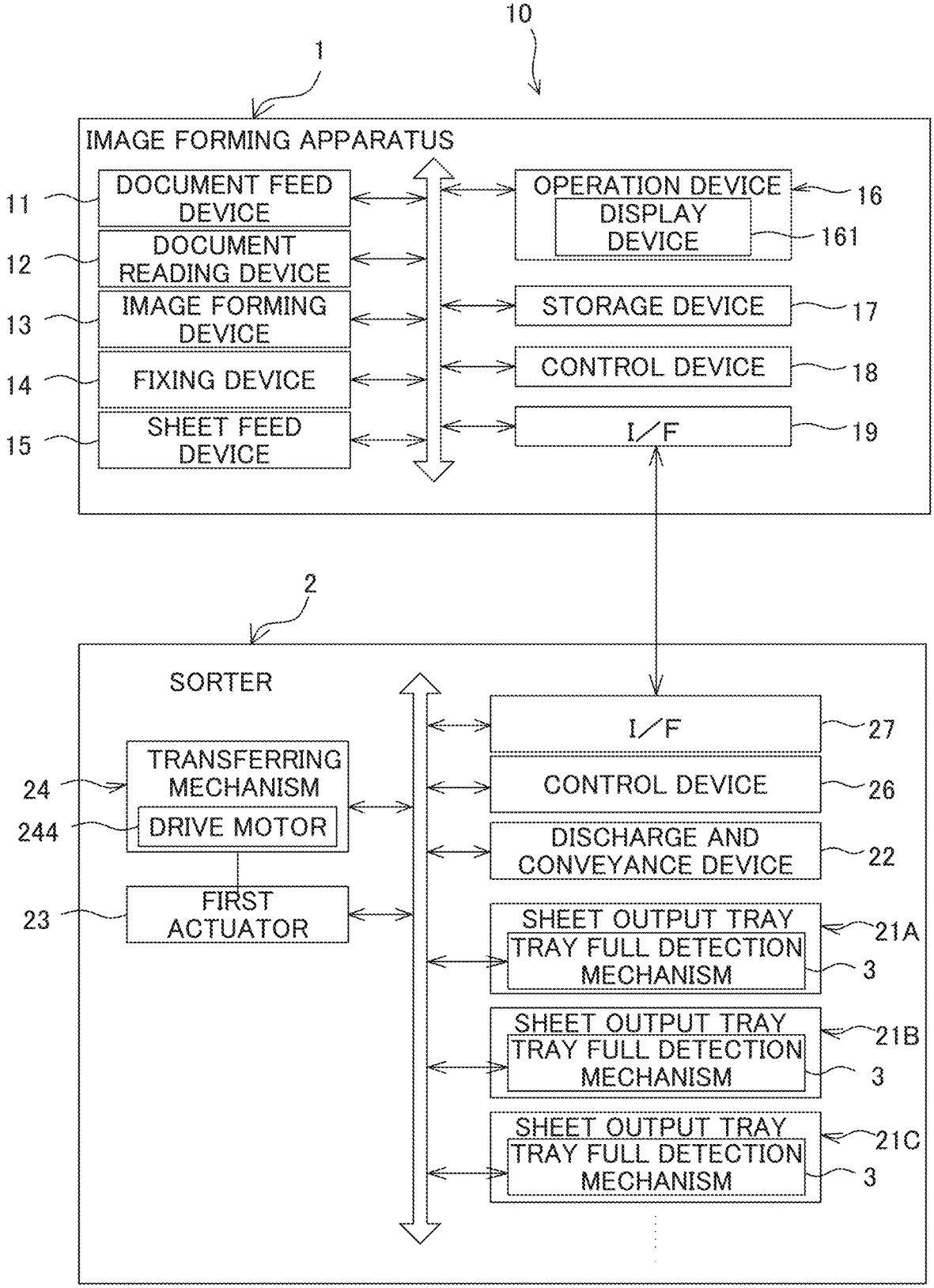
FIG. 11 is a functional block diagram schematically showing an essential internal configuration of the image formation system.

FIG. 11 is a functional block diagram schematically showing an essential internal configuration of the image formation system 10. As shown in FIG. 11, the image forming apparatus 1 includes a document feed device 11, a document reading device 12, an image forming device 13, a fixing device 14, a sheet feed device 15, an operation device 16, a storage device 17, a control device 18, and a communication interface (I/F) 19.

The document feed device 11 is mounted by hinges or the like on the top surface of the document reading device 12 and is thus openable and closable relative to the document reading device 12. The document feed device 11 functions as a document holding cover when the document reading device 12 reads an original document placed on a platen glass. The document feed device 11 is an automatic document feed device called an ADF (auto document feeder). The document feed device 11 includes a document loading tray and feeds, on a sheet-by-sheet basis, original documents loaded onto the document loading tray to the document reading device 12.

First, a description will be given of the case where a document reading operation is performed on the image forming apparatus 1. The document reading device 12 optically reads an image of an original document fed to the document reading device 12 by the document feed device 11 or an image of an original document placed on the platen glass and generates image data on the document. The image data generated by the document reading device 12 is saved in an image memory or the like.

Next, a description will be given of the case where an image forming operation is performed on the image forming apparatus 1. Based on image data generated by the document reading operation, image data stored in the image memory or the like, image data received from a computer connected via a network or another image data, the image forming device 13 forms a toner image on a sheet as a recording medium fed from the sheet feed device 15.

The fixing device 14 applies heat and pressure to the sheet with the toner image formed thereon by the image forming device 13 to fix the toner image on the sheet. The sheet subjected to the fixation processing is conveyed to the sorter 2. The sheet feed device includes one or more sheet feed cassettes.

The operation device 16 accepts user's instructions for various types of operations and processing executable by the image forming apparatus 1, such as an instruction to execute an image forming operation. The operation device 16 includes a display device 161 that displays operation guidance and other types of information for the user. The operation device 16 accepts, through a touch panel provided on the display device 161, an input of a user's instruction based on a user's gesture (for example, a touch gesture) on an operation screen being displayed on the display device 161. The operation device 16 also accepts an input of a user's instruction based on a user's operation on a physical key provided on the operation device 16.

The display device 161 is formed of a liquid crystal display (LCD) or the like. The display device 161 is equipped with a touch panel. When the user makes a touch gesture on a button or key being displayed on the screen, the touch panel accepts an instruction associated with a point where the touch gesture has been made.

The storage device 17 is a large storage device, such as an HDD (hard disk drive) or an SSD (solid state drive). The storage device 17 stores various types of control programs.

The control device 18 includes a processor, a RAM (random access memory), a ROM (read only memory), and a dedicated hardware circuit. The processor is, for example, a CPU (central processing unit), an ASIC (application specific integrated circuit) or an MPU (micro processing unit). The control device 18 executes a control program stored in the above ROM or the storage device 17 to function as a processing device that executes various types of processing and so on necessary for image formation of the image forming apparatus 1.

The control device 18 governs the overall operation control of the image forming apparatus 1. The control device 18 is connected to the document feed device 11, the document reading device 12, the image forming device 13, the fixing device 14, the sheet feed device 15, the operation device 16, the storage device 17, and the communication interface 19 and controls the operations and so on of these components.

The sorter 2 includes the sheet output trays 21A to 21G, the discharge and conveyance device 22, the first actuator 23, the transferring mechanism 24, the plurality of tray full detection mechanisms 3 (tray full detection sensors 36)

provided one for each of the sheet output trays 21, a control device 26, and a communication interface (I/F) 27. These components can send and receive data or signal via a bus to and from each other.

The control device 26 is composed of a processor, a RAM, a ROM, and so on. The control device 26 is connected to the discharge and conveyance device 22, the first actuator 23, the transferring mechanism 24, the tray full detection mechanisms 3 (tray full detection sensors 36), and the communication interface 27 and controls the operations and so on of these components.

The control device 18 of the image forming apparatus 1 and the control device 27 of the sorter 2 input and output data or signal to each other through their respective communication interfaces 19, 27. For example, the control device 18 of the image forming apparatus 1 outputs to the control device 26 of the sorter 2 a control signal for instructing the sorter 2 to execute the sorting operation. The control device 26 of the sorter 2 drives and controls, in response to the received control signal, the discharge and conveyance device 22, the transferring mechanism 24, the first actuator 23, and so on.

The control device 26 controls the operation of the transferring mechanism 24 (specifically, the drive motor 244) to transfer the first actuator 23. The control device 26 identifies the actual location of the first actuator 23 based on a change of a detection signal produced by a change in attitude of the relevant second actuator 31 due to transfer of the first actuator 23 and output from the tray full detection sensor 36 associated with the second actuator 31. Furthermore, the control device 26 determines, based on the detection signal output from the tray full detection sensor 36, whether or not the associated sheet output tray 21 is in a fully loaded condition.

Figure 12:
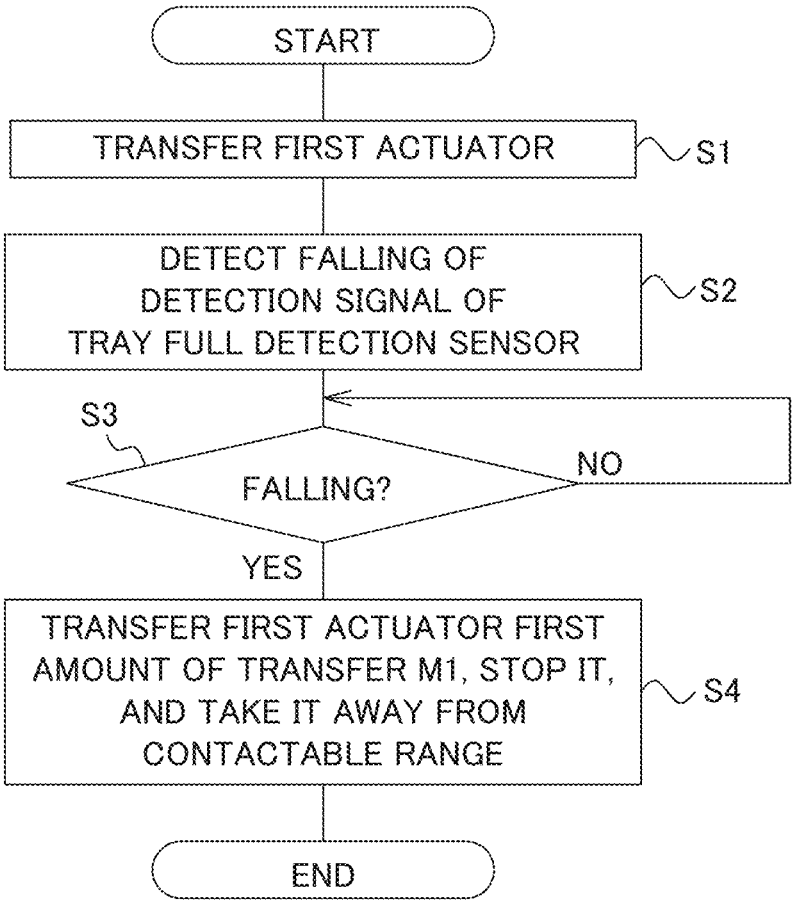
FIG. 12 is a flowchart showing an example of initialization processing.

Next, a description will be given of an example of initialization processing executed by the control device 26 of the sorter 2, with reference to the flowchart shown in FIG. 12.

The control device 26 controls the operation of the transferring mechanism 24 to transfer the first actuator 23 (step S1). The control device 26 acquires a detection signal output from the tray full detection sensor 36 and detects falling of the detection signal (step S2). Specifically, the control device 26 detects a timing at which the first actuator 23 reaches Position A shown in State D in FIG. 7, State E in FIG. 8, and State E in FIG. 9, which is a timing at which the first rear portion 351 falls out of the detection range of the tray full detection sensor 36.

Falling of the detection signal from the tray full detection sensor 36 occurs not only in the case where the first actuator 23 reaches Position A as shown in State D in FIG. 7, State E in FIG. 8, and State E in FIG. 9, but also in the case shown in State H in FIG. 8 and State H in FIG. 9. However, the latter case is the case after the rear portion 35 is freed from the pushing of the first actuator 23, and is therefore the case that should not be detected in step S2.

When detecting falling of the detection signal from the tray full detection sensor 36 (YES in step S3), the control device 26 transfers the first actuator 23 by a predetermined first amount of transfer M1 from the detected timing and stops the first actuator 23 at the position to take the first actuator 23 away from the contactable range where the first actuator 23 can make contact with the rear portion 35 (step S4). After the processing in step S4, the control device 26 ends the initialization processing. The control device 26 sets the first amount of transfer M1 at, for example, a traveling distance D1 (see FIG. 10) of the first actuator 23 corresponding to the above-described contactable range.

Figure 13:
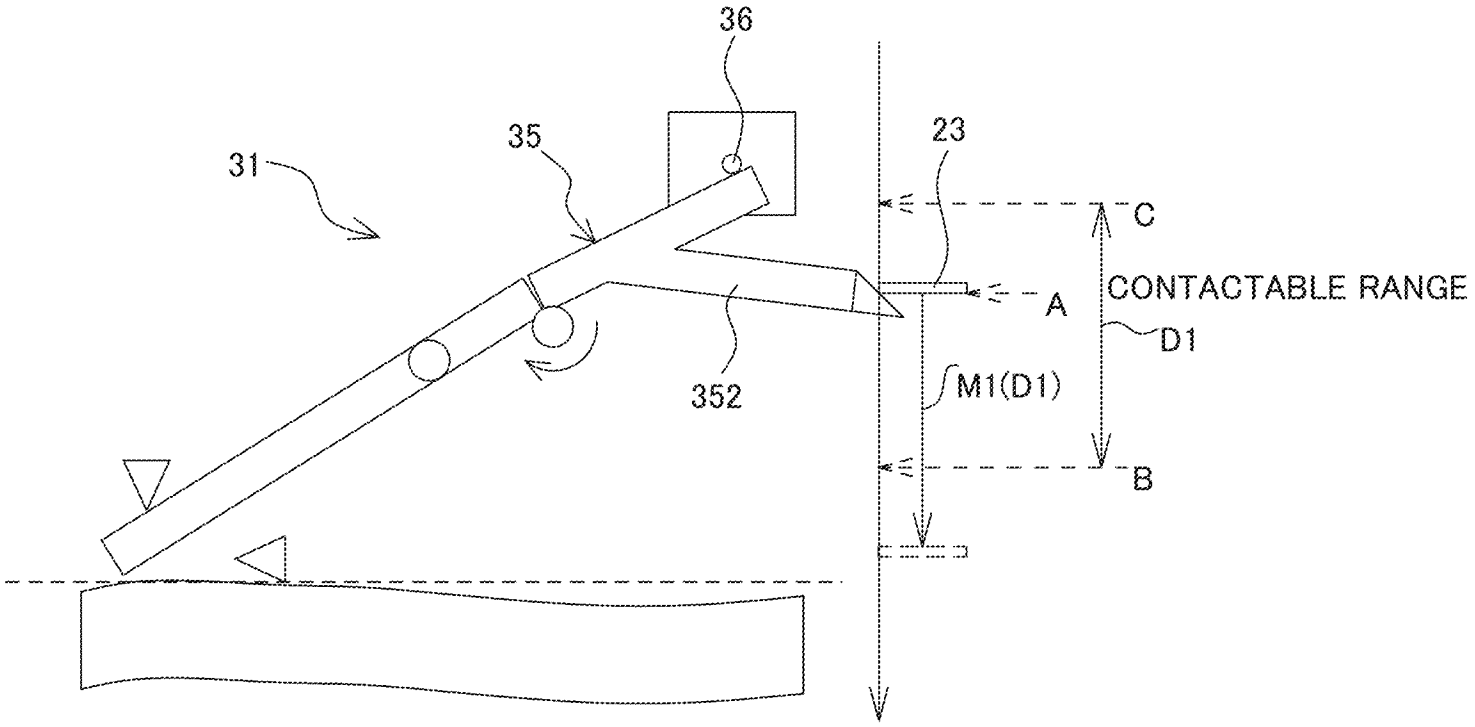
FIG. 13 is a view showing how the first actuator is taken away from the contactable range.

FIG. 13 is a view showing how the first actuator 23 is taken away from the contactable range. By transferring the first actuator 23 by the first amount of transfer M1 (the traveling distance D1) from Position A, the control device 26 can take the first actuator 23 away from the contactable range. The reason why the first actuator 23 is taken away from the contactable range is to avoid the occurrence of inconveniences, such as an adverse effect on the detection of a fully loaded condition of the sheet output tray 21.

The first amount of transfer M1 may be set at a value less than the traveling distance D1. However, when the first amount of transfer M1 is set at a value equal to or more than the traveling distance D1, the first actuator 23 can be surely taken away from the contactable range. If the first amount of transfer M1 is too large, the first actuator 23 may make contact with the rear portion 35 of the next sheet output tray 21 below. Therefore, the first amount of transfer M1 is preferably set at the traveling distance D1.

Figure 14:
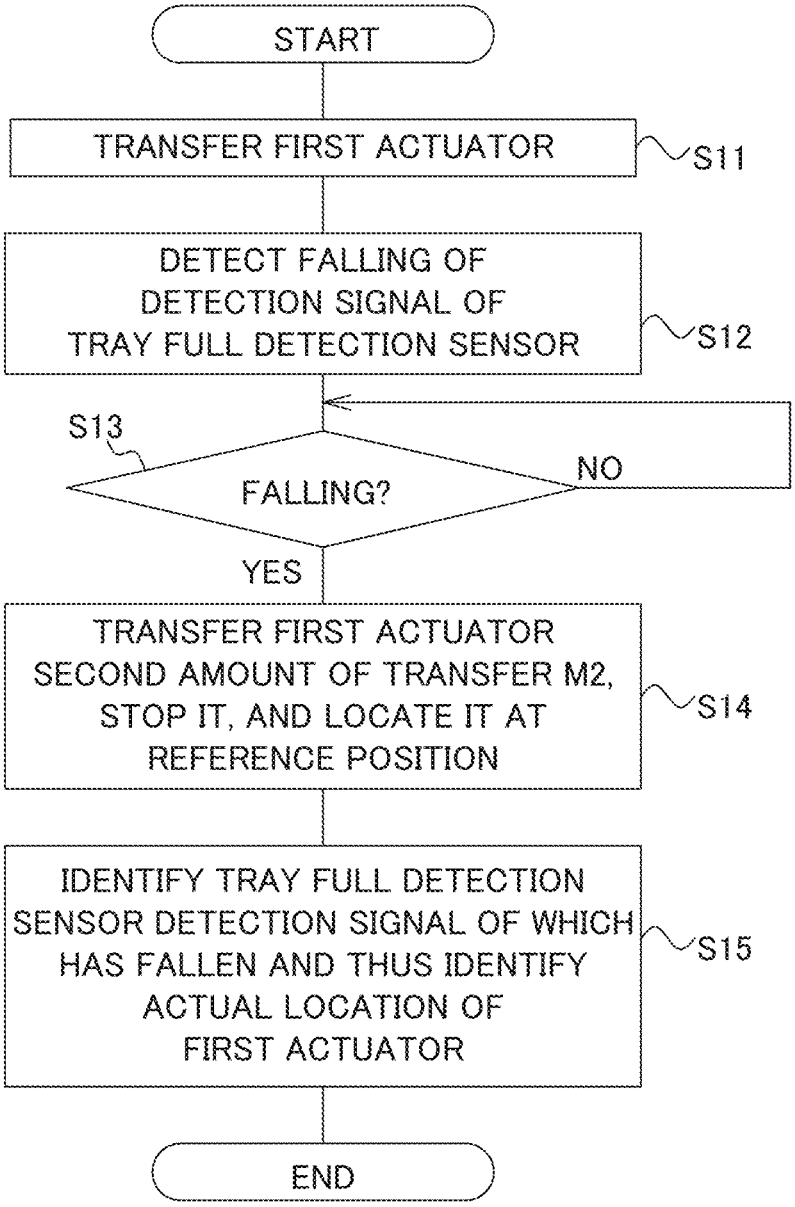
FIG. 14 is a flowchart showing an example of actual location identification processing.

Next, a description will be given of an example of actual location identification processing executed by the control device 26 of the sorter 2, with reference to the flowchart shown in FIG. 14. The actual location identification processing is processing performed for the purpose of identifying the actual location of the first actuator 23. The actual location identification processing overlaps with the previously described initialization processing in many ways.

The control device 26 controls the operation of the transferring mechanism 24 to transfer the first actuator 23 (step S11). The control device 26 acquires a detection signal output from the tray full detection sensor 36 and detects falling of the detection signal (step S12). Specifically, the control device 26 detects a timing at which the first actuator 23 reaches Position A shown in State D in FIG. 7, State E in FIG. 8, and State E in FIG. 9.

When detecting falling of the detection signal output from the tray full detection sensor 36 (YES in step S13), the control device 26 transfers the first actuator 23 by a predetermined second amount of transfer M2 from the detected timing and stops the first actuator 23 at the position to locate the first actuator 23 at a predetermined reference position E (see FIG. 15) (step S14). The control device 26 sets the second amount of transfer M2 at, for example, like the first amount of transfer M1, the traveling distance D1 (see FIG. 10) of the first actuator 23 corresponding to the previously described contactable range.

Figure 15:
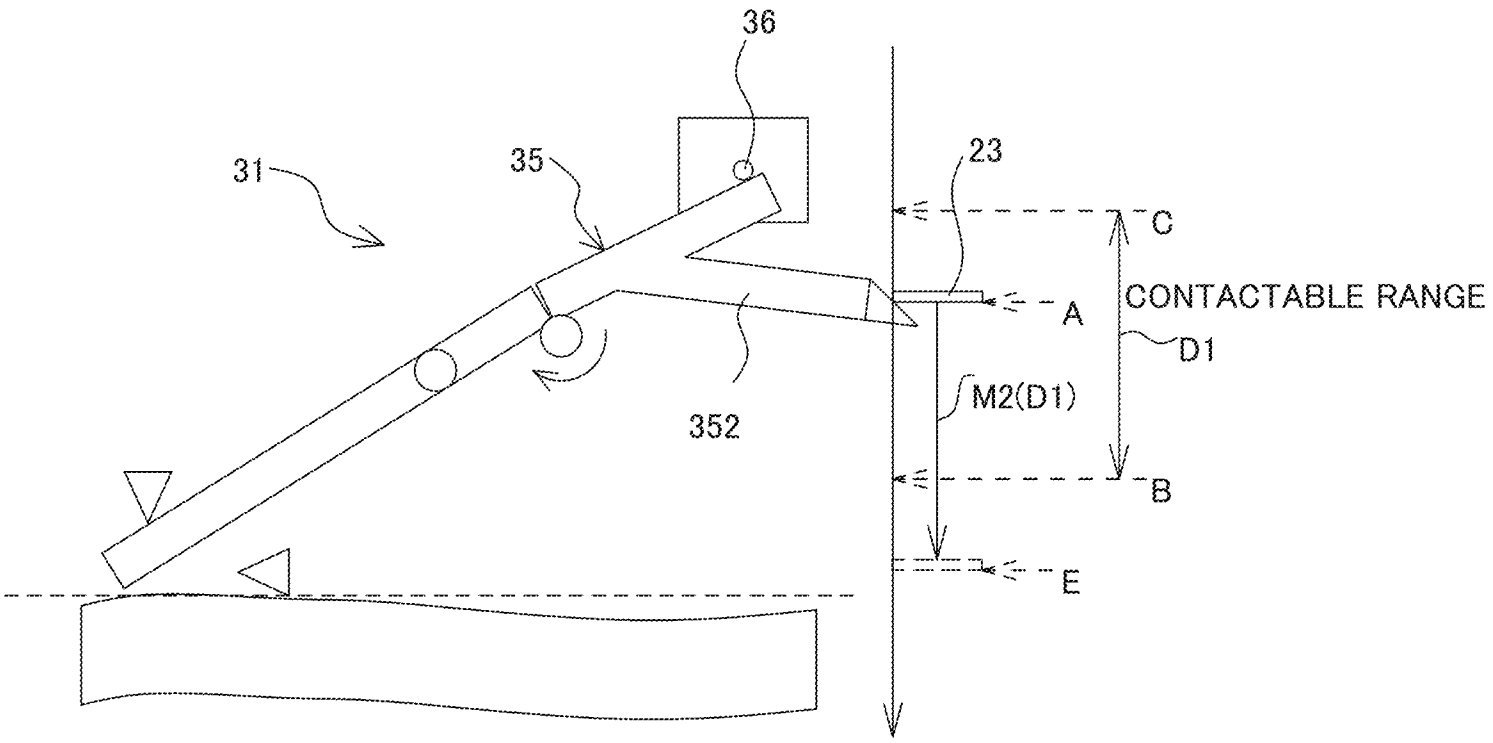
FIG. 15 is a view showing how the first actuator is located at a reference position.

FIG. 15 is a view showing how the first actuator 23 is located at the reference position. The reference position E is set at a location the traveling distance D1 away from Position A. By transferring the first actuator 23 by the second amount of transfer M2 (the traveling distance D1) from the above timing and stopping it at the position, the control device 26 can locate the first actuator 23 at a reference position E set for each of the sheet output trays 21.

Furthermore, the control device 26 identifies the tray full detection sensor 36 the detection signal from which has fallen, thereby identifying the actual location of the first actuator 23 (step S15). After the processing in step S15, the control device 26 ends the actual location identification processing. The reason why the detection signal from the tray full detection sensor 36 changes is that the first actuator 23 is located now next to the sheet output tray 21 for which the tray full detection sensor 36 is provided. Therefore, by identifying the tray full detection sensor 36 the detection signal from which has fallen, the actual location of the first actuator 23 can be identified.

In addition, since the first actuator 23 is located at the above-described reference position E set for each of the sheet output trays 21, then the control device 26 can recognize the accurate location of the first actuator 23.

Figure 16:
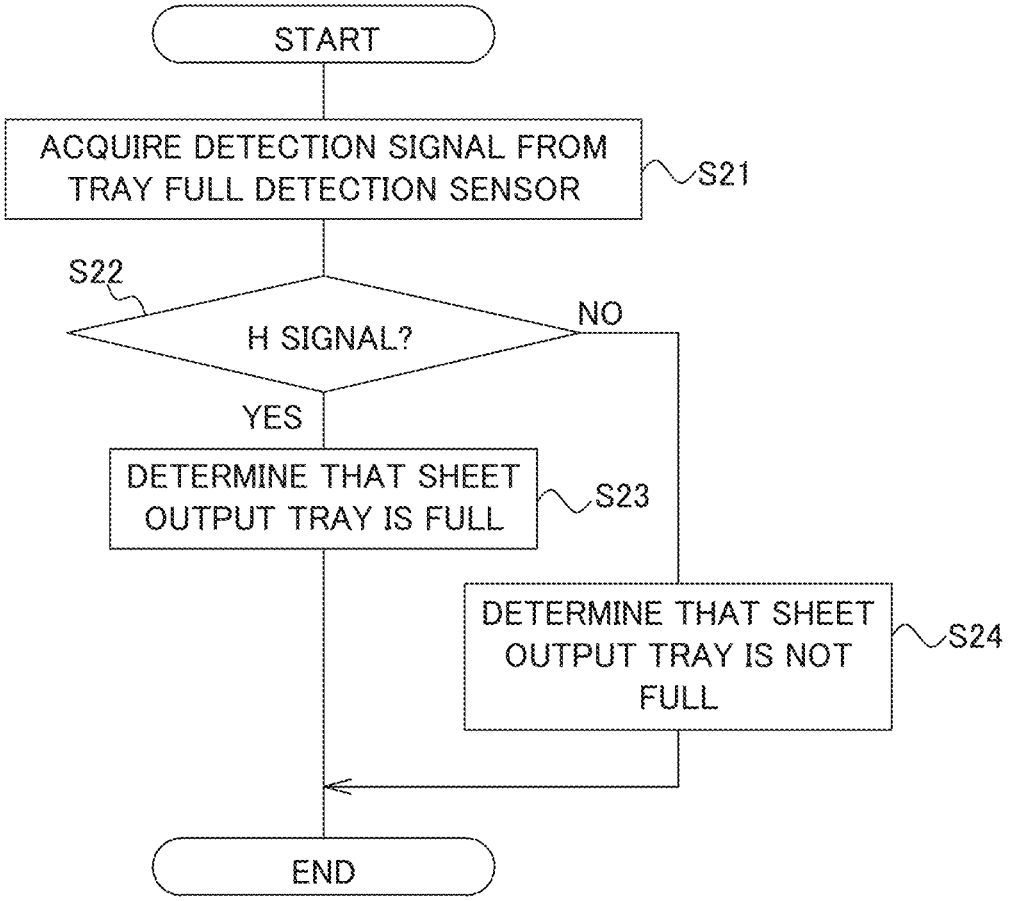
FIG. 16 is a flowchart showing an example of tray full determination processing.

Next, a description will be given of an example of tray full determination processing executed by the control device 26 of the sorter 2, with reference to the flowchart shown in FIG. 16. The tray full determination processing is processing for determining whether or not the associated sheet output tray 21 is in a fully loaded condition.

The control device 26 acquires a detection signal output from the tray full detection sensor 36 (step S21). The control device 26 determines whether or not the acquired detection signal is an H signal (step S22). When determining that the detection signal is an H signal (YES in step S22), the control device 26 determines that the sheet output tray 21 for which the tray full detection sensor 36 is provided is in a fully loaded condition (step S23). After the processing in step S23, the control device 26 ends the tray full determination processing.

On the other hand, when determining that the detection signal is not an H signal (i.e., is an L signal) (NO in step S22), the control device 26 determines that the sheet output tray 21 for which the tray full detection sensor 36 is provided is not in a fully loaded condition (step S24). After the processing in step S24, the control device 26 ends the tray full determination processing. The control device 26 executes the tray full determination processing for each of the plurality of sheet output trays 21A to 21G.

When the previously described initialization processing is executed, the first actuator 23 falls out of the contactable range with the rear portion 35. Therefore, the control device 26 can accurately determine, based on the detection signal from the tray full detection sensor 26, whether or not the associated sheet output tray 21 is in a fully loaded condition.

The general sorter described previously includes a home position sensor. In identifying the actual location of the contact member, the general sorter returns the contact member to a home position, which leads to a poor processing efficiency.

Unlike the above general sorter, in the above embodiment, the control device 26 identifies the actual location of the first actuator 23 based on a change of a detection signal produced by transferring the first actuator 23 and output from the tray full detection sensor 36. Thus, without the need to provide a home position sensor as in the general sorter, the actual location of the first actuator 23 traveling along the row of the plurality of sheet output trays 21 can be identified.

Since, in the above embodiment, a reference position E is set for each of the sheet output trays 21, there is no need to return the first actuator 23 to a single home position in order to identify its actual location, unlike the general sorter. Therefore, the processing efficiency can be increased.

In the above embodiment, the tray full detection sensor 36 is used in order to identify the actual location of the first actuator 23. However, with the first actuator 23 taken away from the contactable range with the rear portion 35, it can be determined, using the tray full detection sensor 36, whether or not the sheet output tray 21 is in a fully loaded condition. Therefore, the determination of whether or not the sheet output tray 21 is in a fully loaded condition can be appropriately performed.

The present disclosure is not limited to the above embodiment and can be modified in various ways. The structure, configuration, and processing of the embodiment described with reference to FIGS. 1 to 16 are merely illustrative and are not intended to limit the present disclosure to them.

While the present disclosure has been described in detail with reference to the embodiments thereof, it would be apparent to those skilled in the art the various changes and modifications may be made therein within the scope defined by the appended claims.

What is claimed is:

1. A sorter comprising:

a plurality of sheet output trays aligned in a predetermined direction and each capable of loading sheets thereon;

a first actuator that travels in the predetermined direction along the plurality of sheet output trays to guide a sheet onto any one of the plurality of sheet output trays;

a transferring mechanism that transfers the first actuator in the predetermined direction;

a control device that includes a processor and controls an operation of the transferring mechanism through the processor executing a control program; and a plurality of tray full detection mechanisms provided one for each of the plurality of sheet output trays, wherein each of the plurality of tray full detection mechanisms comprises:

a second actuator rotatable about a pivot pin in both a first rotational direction and a second rotational direction opposite to the first rotational direction; and a tray full detection sensor that detects a fully loaded condition of the associated sheet output tray, the second actuator comprises:

a first portion capable of abutting at a distal end thereof on an uppermost one of the sheets loaded on the associated sheet output tray;

a second portion located on a traveling path of the first actuator and disposed to fall within a predetermined detection range of the tray full detection sensor in the fully loaded condition of the associated sheet output tray; and a connecting portion that connects between the first portion and the second portion and biases the second portion in the second rotational direction, each of the plurality of tray full detection mechanisms further comprises:

a first stopper that restricts rotation of the first portion in the first rotational direction; and a second stopper that restricts rotation of the first portion in the second rotational direction, the second actuator rotates in the first rotational direction when an amount of sheets loaded on the associated sheet output tray increases or when the second portion is pushed by the first actuator, when the second portion is pushed by the first actuator while the rotation of the first portion in the first rotational direction is stopped by the first stopper, the second portion rotates in the first rotational direction about the connecting portion, when freed from pushing of the first actuator, the second portion is restored to an original position by biasing of the connecting portion, and the control device identifies an actual location of the first actuator based on a change of a detection signal produced by a change in attitude of the second actuator due to transfer of the first actuator and output from the tray full detection sensor.

2. The sorter according to claim 1, wherein the control device performs initialization processing for allowing the transferring mechanism to transfer the first actuator, detecting, based on a detection signal output from the tray full detection sensor, that the second portion has fallen out of the detection range, allowing the transferring mechanism to transfer the first actuator by a predetermined first amount of transfer from a timing of detection that the second portion has fallen out of the detection range, thereby taking the first actuator away from a contactable range within which the first actuator is contactable with the second portion.

3. The sorter according to claim 2, wherein the control device sets the first amount of transfer at a traveling distance of the first actuator corresponding to the contactable range within which the first actuator and the second portion is contactable with each other.

4. The sorter according to claim 2, wherein while the control device takes the first actuator away from the contactable range within which the first actuator is contactable with the second portion, the control device determines, based on the detection signal output from the tray full detection sensor, whether or not the associated sheet output tray is in the fully loaded condition.

5. The sorter according to claim 1, wherein the control device allows the transferring mechanism to transfer the first actuator, identifies the actual location of the first actuator based on a change of the detection signal output from the tray full detection sensor, and detects, based on the detection signal output from the tray full detection sensor, that the second portion has fallen out of the detection range, and the control device allows the transferring mechanism to transfer the first actuator by a predetermined second amount of transfer from a timing of detection that the second portion has fallen out of the detection range, thereby locating the first actuator at a predetermined reference position.

6. The sorter according to claim 5, wherein the control device sets the second amount of transfer at a traveling distance of the first actuator corresponding to a contactable range within which the first actuator and the second portion is contactable with each other.

7. The sorter according to claim 1, the pivot pin of the second actuator is provided on the first portion.

* * * * *